US007760063B2

(12) United States Patent
Lin et al.

(10) Patent No.: US 7,760,063 B2
(45) Date of Patent: Jul. 20, 2010

(54) STRUCTURE OF TRANSFORMER

(75) Inventors: Tsai-Sheng Lin, Taoyuan Hsien (TW); Zhi-Liang Zhang, Taoyuan Hsien (TW); His-Kuo Chung, Taoyuan Hsien (TW); Chun-Hao Liao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 37 days.

(21) Appl. No.: 12/236,282

(22) Filed: Sep. 23, 2008

(65) Prior Publication Data

US 2010/0026445 A1 Feb. 4, 2010

(30) Foreign Application Priority Data

Aug. 4, 2008 (TW) ..... 97129571 A

(51) Int. Cl.
*H01F 27/30* (2006.01)
*H01F 21/02* (2006.01)
*H01F 27/28* (2006.01)
*H01F 27/29* (2006.01)

(52) U.S. Cl. ..... 336/208; 336/145; 336/182; 336/192; 336/198

(58) Field of Classification Search ..... None
See application file for complete search history.

(56) References Cited

U.S. PATENT DOCUMENTS 4,939,494 A * 7/1990 Masuda et al. ..... 336/96
5,264,815 A * 11/1993 Umeya et al. ..... 336/96
5,534,839 A * 7/1996 Mackin et al. ..... 336/192
5,996,214 A * 12/1999 Bell ..... 29/605
6,078,240 A * 6/2000 Huang ..... 336/90
6,734,777 B2 * 5/2004 Yeh et al. ..... 336/208
7,116,205 B2 * 10/2006 Hsueh et al. ..... 336/212
7,142,079 B2 * 11/2006 Chang ..... 336/90
7,365,501 B2 * 4/2008 Ushijima et al. ..... 315/278
7,449,986 B2 * 11/2008 Yamaguchi et al. ..... 336/192
2005/0073385 A1 * 4/2005 Wu et al. ..... 336/208
2007/0024406 A1 * 2/2007 Hao ..... 336/208
2007/0216511 A1 * 9/2007 Tseng et al. ..... 336/208

* cited by examiner

*Primary Examiner*—Elvin G Enad
*Assistant Examiner*—Mangtin Lian
(74) *Attorney, Agent, or Firm*—Kirton & McConkie; Evan R. Witt

(57) ABSTRACT

A transformer includes a bobbin, a primary winding coil, a secondary winding coil, a case and a magnetic core assembly. The bobbin includes a winding member, a first channel, and multiple ground pins. The ground pins have first terminal parts protruded from a surface of the winding member. The primary winding coil and the secondary winding coil wound around the winding member. The case includes a receiving portion for partially accommodating the winding member therein, a second channel communicated with the receiving portion, and multiple perforations corresponding to the ground pins. The first terminal parts are penetrated through the perforations and protruded from a surface of the case when the winding member is accommodated in the receiving portion. The magnetic core assembly is partially embedded into the first channel and the second channel, so that the magnetic core assembly is contacted with the first terminal parts of the ground pins.

12 Claims, 6 Drawing Sheets

2

2

22

STRUCTURE OF TRANSFORMER

FIELD OF THE INVENTION

The present invention relates to a transformer, and more particularly to a transformer having a simple and easily assembled structure and low electromagnetic interference.

BACKGROUND OF THE INVENTION

A transformer has become an essential electronic component for voltage regulation into required voltages for various kinds of electric appliances. Referring to FIG. 1, a schematic exploded view of a conventional transformer is illustrated. The transformer 1 principally comprises a magnetic core assembly 11, a bobbin 12, a primary winding coil 13, a secondary winding coil 14 and an insulating tape 15. The bobbin 12 comprises a first side plate 121, a second side plate 122 and a winding member 123. The insulating tape 15 is wound around the middle portion of the winding member 123. The winding member 123 is divided into a first winding section 1231 and a second winding section 1232, which are located at bilateral sides of the insulating tape 15. The primary winding coil 13 and the secondary winding coil 14 are wound around the first winding section 1231 and the second winding section 1232, respectively. The primary winding coil 13 and the secondary winding coil 14 are separated from each other by the insulating tape 15, thereby providing a desired creepage distance.

Although the transformer 1 is effective for power conversion, there are still some drawbacks. For example, during power conversion of the transformer 1, the magnetic core assembly 11 is readily charged and thus suffered from electromagnetic interference (EMI). For suppressing EMI, the outer periphery of the transformer 1 is usually shielded by a copper foil (not shown) according to an electrostatic screening effect. The arrangement of the copper foil may increase the fabricating cost of the transformer. Furthermore, the procedure of winding the copper foil around the outer periphery of the transformer 1 is very labor-intensive and time-consuming and thus the throughput is insufficient.

Therefore, there is a need of providing an improved transformer so as to obviate the drawbacks encountered from the prior art.

SUMMARY OF THE INVENTION

It is an object of the present invention to provide a transformer having a simple and easily assembled structure.

Another object of the present invention provides a transformer with low electromagnetic interference without the need of using copper foil to shield the outer periphery thereof.

In accordance with an aspect of the present invention, there is provided a transformer. The transformer includes a bobbin, a primary winding coil, a secondary winding coil, a case and a magnetic core assembly. The bobbin includes a winding member, a first channel, and multiple ground pins. The first channel runs through the winding member. The ground pins are penetrated through the winding member and have first terminal parts protruded from a surface of the winding member. The primary winding coil and the secondary winding coil wound around the winding member. The case includes a receiving portion for partially accommodating the winding member therein, a second channel communicated with the receiving portion, and multiple perforations corresponding to the ground pins. The first terminal parts of the ground pins are penetrated through the perforations and protruded from a surface of the case when the winding member is accommodated in the receiving portion. The magnetic core assembly is partially embedded into the first channel of the bobbin and the second channel of the case, so that the magnetic core assembly is contacted with the first terminal parts of the ground pins.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
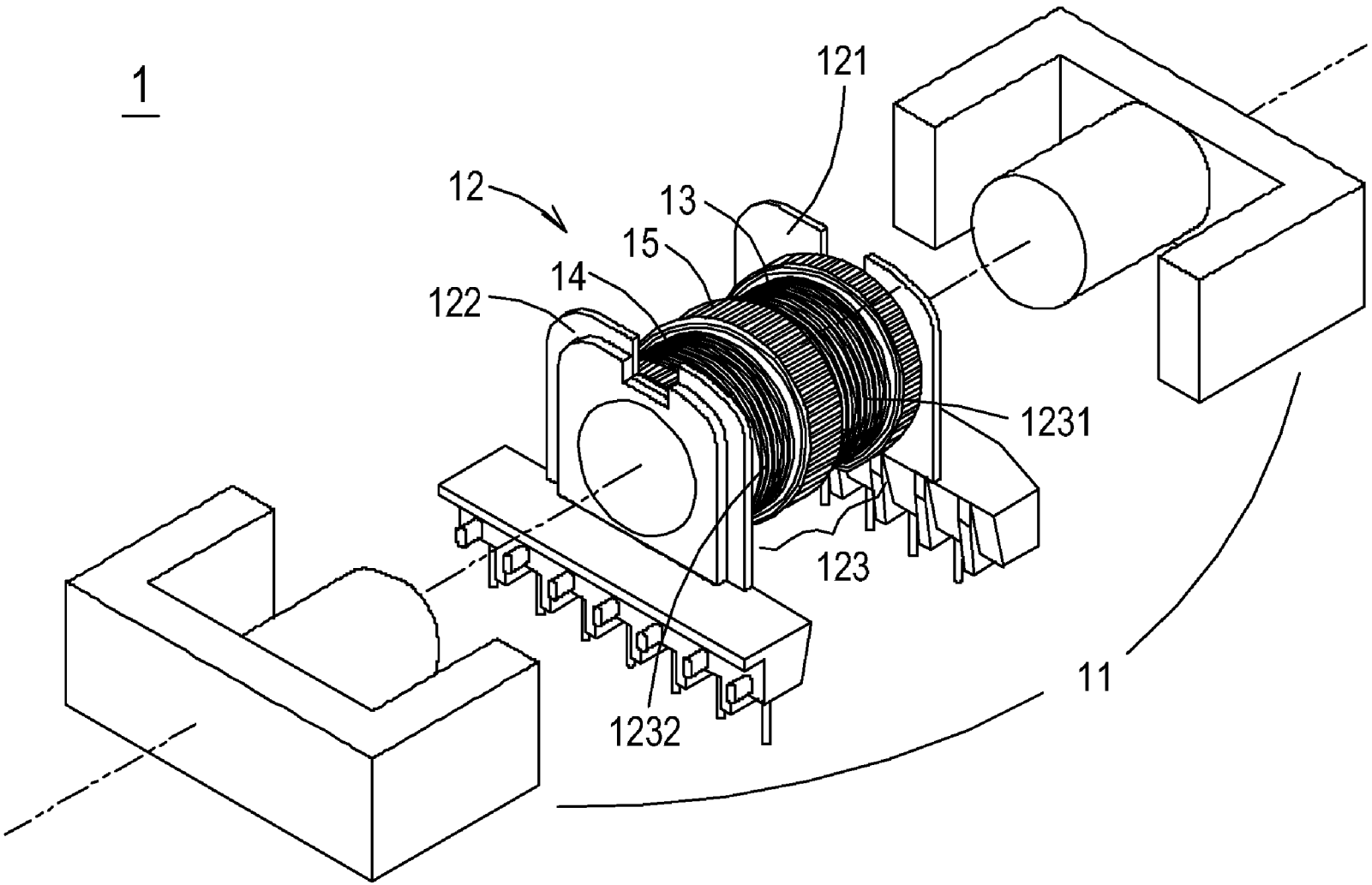
FIG. 1 PRIOR ART
FIG. 1 is a schematic exploded view of a conventional transformer.
Figure 2:
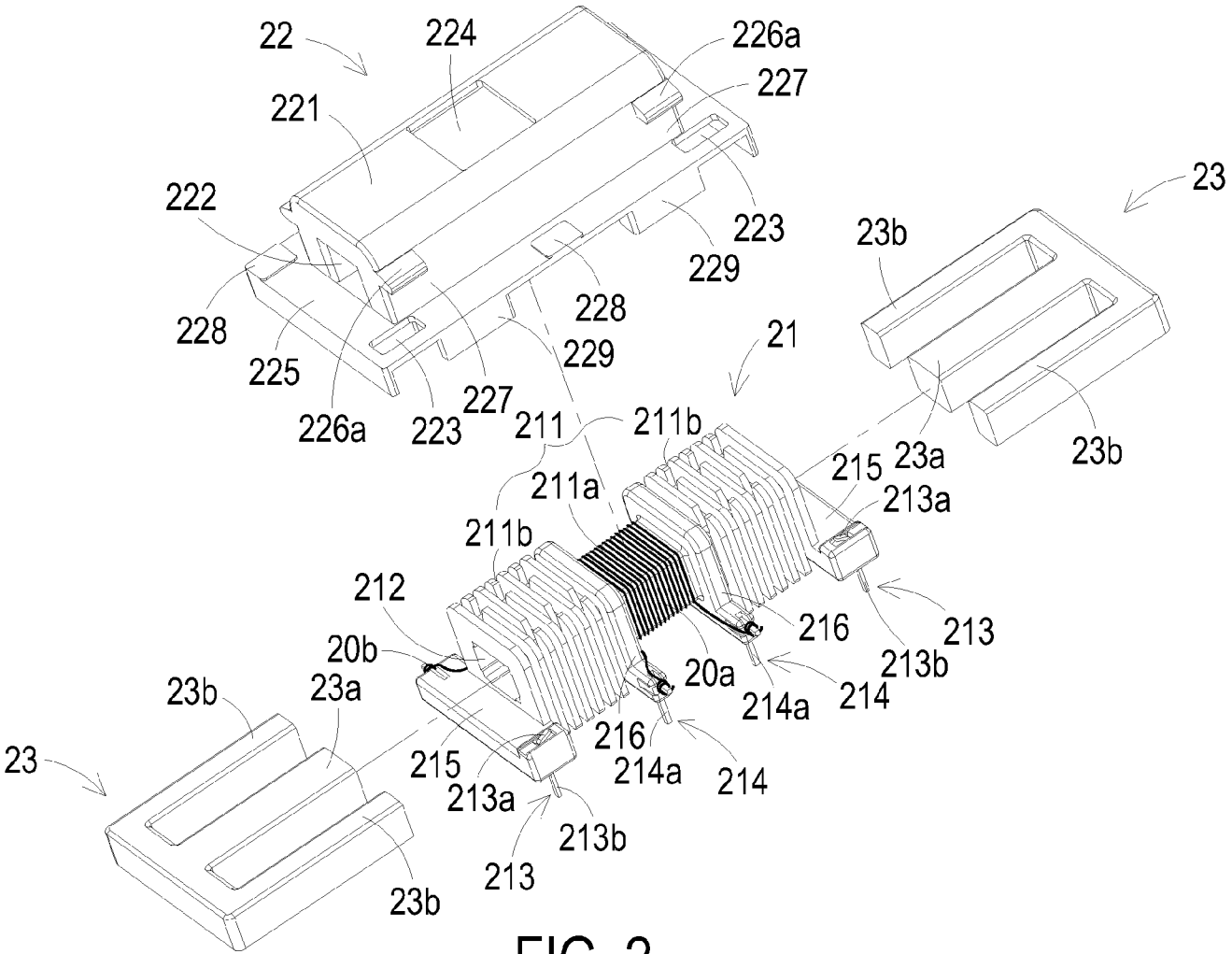
FIG. 2 is a schematic exploded view of a transformer according to a preferred embodiment of the present invention.

FIG. 2 is a schematic exploded view of a transformer according to a preferred embodiment of the present invention. The transformer 2 principally comprises a bobbin 21, a case 22 and a magnetic core assembly 23. An example of the magnetic core assembly 23 includes but is not limited to an EE-type core assembly, which are composed of two E-shaped magnetic parts. Each E-shaped magnetic part includes a middle portion 23*a* and two leg portions 23*b*, which are disposed at bilateral sides of the middle portion 23*a*.

The bobbin 21 comprises a winding member 211, a channel 212, multiple ground pins 213, multiple conductive pins 214, multiple first pin seats 215 and multiple second pin seats 216. The winding member 211 includes a first winding section 211*a* and at least one second winding section 211*b*. A primary winding coil (20*a*) and a secondary winding coil (20*b*) are wound around the first winding section 211*a* and the second winding section 211*b*, respectively. The channel 212 runs through the winding member 211. The middle portions 23*a* of the magnetic parts of the magnetic core assembly 23 are partially embedded into the channel 212. As a consequence, the primary winding coil 20*a* wound around the first winding section 211*a* and the secondary winding coil 20*b* wound around the second winding section 211*b* will interact with the magnetic core assembly 23 to achieve the purpose of voltage regulation. The first pin seats 215 are arranged on bilateral sides of the winding member 211. The ground pins 213 and some of the conductive pins 214 are disposed on the first pin seats 215. The second pin seats 216 are arranged between the first pin seats 215. The remaindering conductive pins 214 are disposed on the second pin seats 216.

Figure 3:
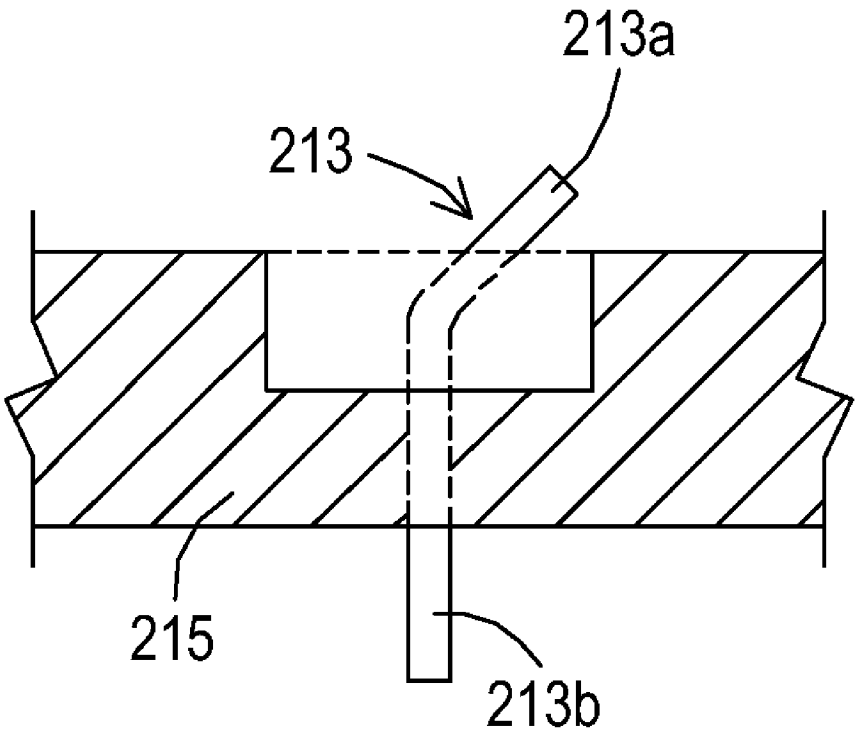
FIG. 3 is a schematic partial cross-sectional view illustrating a ground pin inserted in a first pin seat.

FIG. 3 is a schematic partial cross-sectional view illustrating a ground pin inserted in a first pin seat. The ground pin 213 is elastic and made of metallic material. The ground pin 213 includes a first terminal part 213*a* and a second terminal part 213*b*. The first terminal part 213*a* and the second terminal part 213*b* are integrally formed. An included angle between the first terminal part 213*a* and the second terminal part 213*b* is greater than 90 degree such that the ground pin 213 is substantially a tilt-bend structure. Please refer to FIGS. 2 and 3. The ground pins 213 are arranged on the lower surfaces of the first pin seats 215 of the bobbin 21. The second terminal parts 213*b* of the ground pins 213 are penetrated through the first pin seats 215 and protruded downwardly from the lower surfaces of the first pin seats 215 to be fixed onto a system circuit board (not shown) and electrically connected to corresponding ground terminals (not shown) of the system circuit board. The first terminal part 213*a* is slantwise protruded from the upper surfaces of the first pin seats 215 to be contacted with the leg portions 23*b* of the magnetic core assembly 23.

Figure 4:
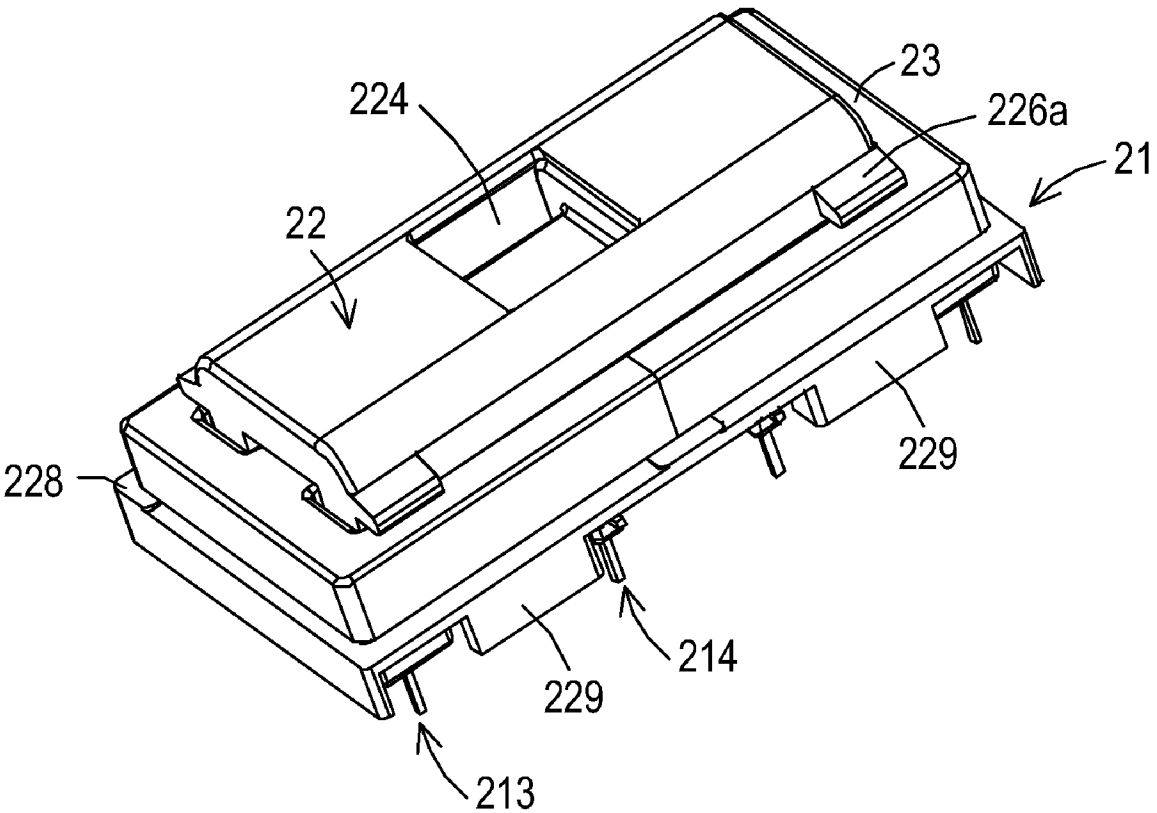
FIG. 4 is a schematic assembled view of the transformer of FIG. 2.

Please refer to FIG. 2. The conductive pins 214 are L-shaped. Some of the conductive pins 214 are arranged on the first pin seats 215 and the other conductive pins 214 are arranged on bilateral sides of the second pin seats 216. The conductive pins 214 are penetrated through the first pin seats 215 or the second pin seats 216. The conductive pins 214 have terminal parts 214*a* protruded downwardly from the lower surfaces of the first pin seats 215 or the second pin seats 216 to be fixed onto the system circuit board. After the bobbin 21, the case 22 and the magnetic core assembly 23 are assembled into the transformer 2 (as shown in FIG. 4), the second terminal parts 213*b* of the ground pins 213 and the terminal parts 214*a* of the conductive pins 214 are soldered onto corresponding contact portions of the system circuit board such that the transformer 2 is mounted on the system circuit board.

Depending on the practical requirements, the numbers and the positions of the ground pins 213 and the conductive pins 214 are variable. For example, the ground pins 213 may be disposed on the second pin seats 216. In some embodiments, some perforations (not shown) may be firstly drilled in the first pin seats 215 or the second pin seats 216 and then the ground pins 213 or the conductive pins 214 are inserted into the perforations, thereby fixing the ground pins 213 or the conductive pins 214 on the first pin seats 215 or the second pin seats 216.

Please refer to FIGS. 2 and 4 again. The case 22 has a hollow receiving portion 221, a channel 222 and multiple perforations 223. The receiving portion 221 has a receptacle defined by the inner sidewalls of the case 22 for accommodating the winding member 211 of the bobbin 21 therein. The case 22 further has a ventilation hole 224 corresponding to the first winding section 211*a* of the winding member 211. During operation of the transformer 2, the heat generated by the primary winding coil 20*a* wound around the first winding section 211*a* and the secondary winding coil 20*b* wound around the second winding section 211*b* will be exhausted through the ventilation hole 224.

The channel 222 of the case 22 is communicated with the receiving portion 221. After the winding member 211 of the bobbin 21 is accommodated within the receiving portion 221, the channel 212 of the bobbin 21, the channel 222 of the case 22 is communicated with the channel 212 of the bobbin 21. Next, the middle portions 23*a* of the magnetic parts of the magnetic core assembly 23 are partially embedded into the channel 222 of the case 22 and the channel 212 of the bobbin 21.

The case 22 also has a base plate 225, which is extended from the bottom edges of the case 22. The perforations 223 are formed in the base plate 225 corresponding to the locations of the ground pins 213 of the bobbin 21. When the winding member 211 of the bobbin 21 is accommodated within the receiving portion 221, the channel 212 of the bobbin 21, the first terminal parts 213*a* of the ground pins 213 are penetrated through the perforations 223 and slantwise protruded from the base plate 225 of the case 22. After the middle portions 23*a* of the magnetic core assembly 23 are partially embedded into the channel 222 of the case 22 and the channel 212 of the bobbin 21, the leg portions 23*b* of the magnetic core assembly 23 are contacted with the first terminal parts 213*a* of the ground pins 213 due to the gravity of the magnetic core assembly 23. Since the magnetic core assembly 23 are contacted with the first terminal parts 213*a* of the ground pins 213 and the ground pins 213 are connected to the ground terminals of the system circuit board, the electromagnetic interference generated during operation of the transformer 2 will be conducted away to the ground terminals of the system circuit board. Under this circumstance, no copper foil is required to shield the outer periphery of the transformer 2 such that the fabricating cost is reduced and the throughput is enhanced.

In some embodiments, after the bobbin 21, the case 22 and the magnetic core assembly 23 are assembled into the transformer 2, an insulation tape (not shown) may be wound around the outer periphery of the transformer 2 so as to securely combine the bobbin 21, the case 22 and the magnetic core assembly 23 together. Alternatively, an adhesive may be applied on the junctions between the magnetic core assembly 23 and the case 22 so as to securely combine the bobbin 21, the case 22 and the magnetic core assembly 23 together.

For assuring direct contact between the leg portions 23*b* of the magnetic core assembly 23 and the first terminal parts 213*a* of the ground pins 213, the case 22 may further comprises a fixing member. In an embodiment, the fixing member comprises a plurality sustaining blocks 226*a*, which are extended from the top edges of bilateral sides of the receiving portion 221 and substantially disposed on four corners of the receiving portion 221. Two guiding tracks 227 are defined between the base plate 225 and respective sustaining blocks 226*a* at bilateral sides of the case 22. While the middle portions 23*a* of the magnetic core assembly 23 are partially embedded into the channel 222 of the case 22 and the channel 212 of the bobbin 21, the leg portions 23*b* of the magnetic core assembly 23 are moved along the guiding tracks 227 and received in the guiding tracks 227. After the leg portions 23*b* of the magnetic core assembly 23 are received in the guiding tracks 227, the sustaining blocks 226*a* are sustained against the leg portions 23*b* of the magnetic core assembly 23 such that the leg portions 23*b* of the magnetic core assembly 23 are pushed downwardly to compress the first terminal parts 213*a* of the ground pins 213. As such, the first terminal parts 213*a* of the ground pins 213 are moved downwardly. Since the first terminal parts 213*a* of the ground pins 213 are elastic, the first terminal parts 213*a* exert elastic forces on the leg portions 23*b* of the magnetic core assembly 23. Due to the elastic forces, the leg portions 23*b* of the magnetic core assembly 23 are in close contact with the first terminal parts 213*a* of the ground pins 213.

Figure 5:
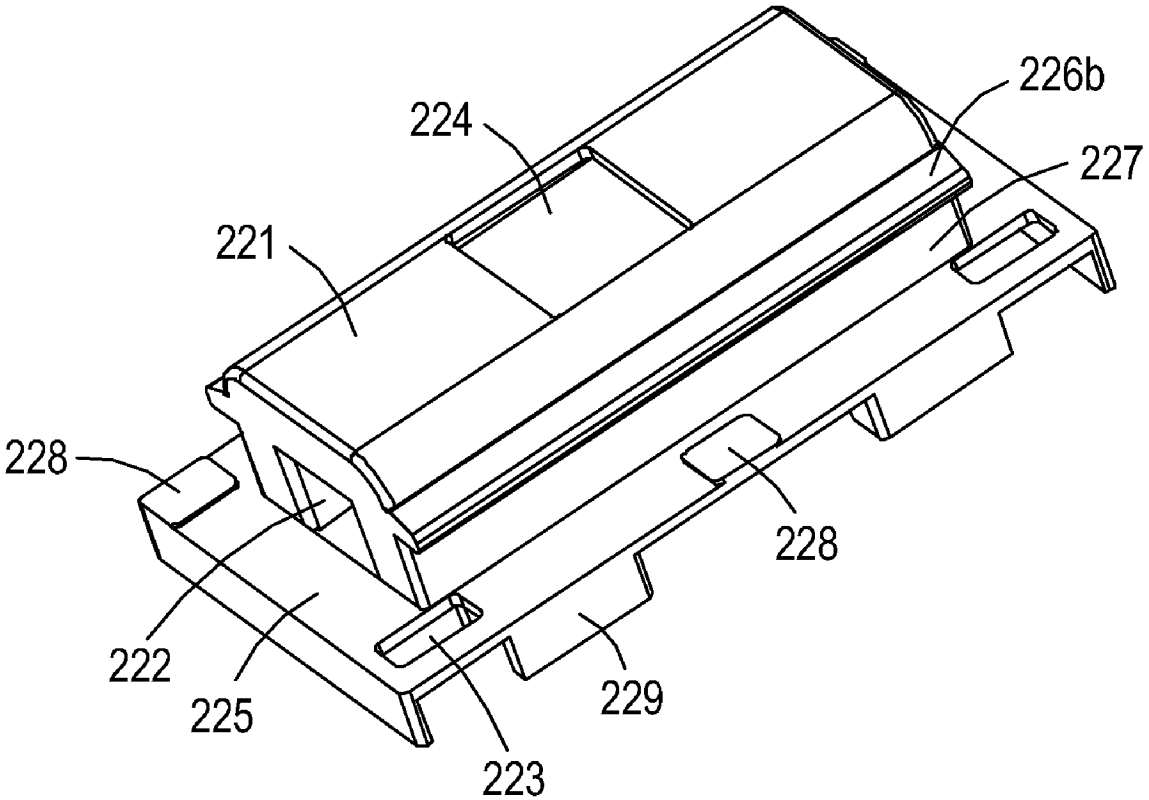
FIG. 5 is a schematic perspective view illustrating another fixing member of the case.

It is noted that, however, those skilled in the art will readily observe that numerous modifications and alterations of the fixing member may be made while retaining the teachings of the invention. In another embodiment as shown in FIG. 5, fixing member comprises a plurality sustaining protrusion plates 226*b*, which are extended from the top edges of the receiving portion 221. Similarly, two guiding tracks 227 are defined between the base plate 225 and respective sustaining protrusion plates 226*b* at bilateral sides of the case 22. While the middle portions 23*a* of the magnetic core assembly 23 are partially embedded into the channel 222 of the case 22 and the channel 212 of the bobbin 21, the leg portions 23*b* of the magnetic core assembly 23 are moved along the guiding tracks 227 and received in the guiding tracks 227. The sustaining protrusion plates 226*b* are substantially elongated strips and the length of each sustaining protrusion plate 226*b* is equal to that of the receiving portion 221. After the leg portions 23*b* of the magnetic core assembly 23 are received in the guiding tracks 227, the sustaining protrusion plates 226*b* are sustained against the leg portions 23*b* of the magnetic core assembly 23 such that the leg portions 23*b* of the magnetic core assembly 23 are pushed downwardly to compress the first terminal parts 213*a* of the ground pins 213.

Figure 6:
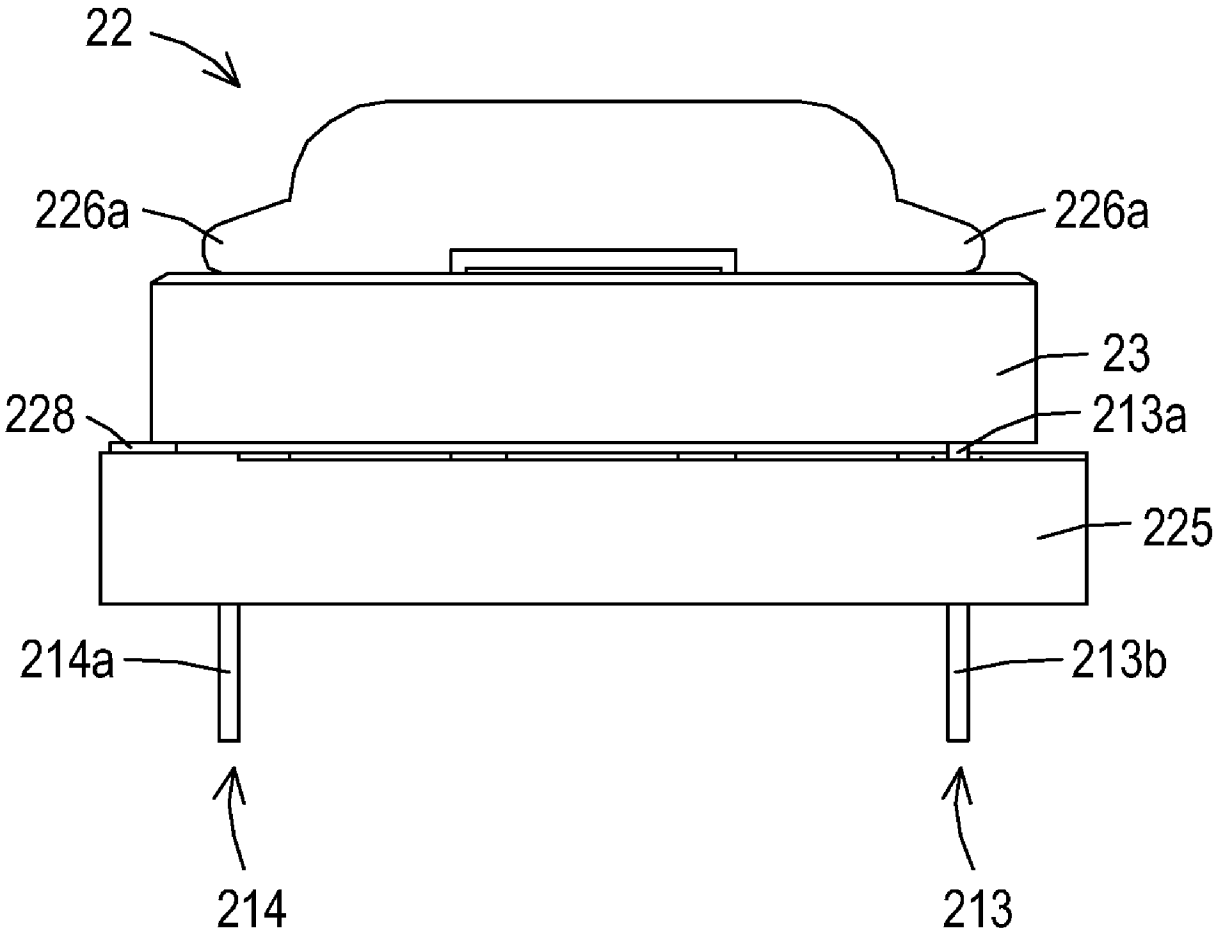
FIG. 6 is a schematic perspective view illustrating that the magnetic core assembly is simultaneously supported by the raised blocks and the first terminal parts of the ground pins.

Since the first terminal parts 213*a* of the ground pins 213 are slightly protruded over the base plate 225 of the case 22, the leg portions 23*b* of the magnetic core assembly 23 which are in direct contact with the first terminal parts 213*a* of the ground pins 213 are possibly uplifted. Due to the height difference between bilateral sides of the leg portions 23*b*, the magnetic core assembly 23 fails to be securely fixed on the case 22. Please refer to FIG. 2 again. For solving such a problem, several raised blocks 228 are optionally provided on the base plate 225 of the case 22 at the side opposite to the perforations 223. Optionally, one or more additional raised blocks 228 may be disposed on the base plate 225 of the case 22 at the locations between the perforations 223. The height of the raised blocks 228 are selected such that the raised blocks 228 and the first terminal parts 213*a* protruded over the base plate 225 are substantially at the same level. When the magnetic core assembly 23 is combined with the case 22, the leg portions 23*b* of the magnetic core assembly 23 are simultaneously contacted with the first terminal parts 213*a* of the ground pins 213 and the raised blocks 228. As a consequence, the magnetic core assembly 23 can be securely fixed on the case 22, as is shown in FIG. 6. Depending on the practical requirements, the numbers and the positions of the ground pins 213 and the conductive pins 214 are variable.

Please refer to FIG. 2. In some embodiments, the case 22 further comprises multiple protective slices 229, which are downwardly extended from bilateral sides of the base plate 225 and corresponding to the second winding sections 211*b* of the winding member 211. After the winding member 211 is accommodated within the receiving portion, the secondary winding coils 20*b* wound around the second winding sections 211*b* are shielded by the protective slices 229 so as to prevent the secondary winding coils 20*b* from being touched by the user.

From the above description, it is found that the transformer of the present invention has a simple and easily assembled structure. After the magnetic core assembly is combined with the case, the magnetic core assembly is contacted with the ground pins of the bobbin such that the electromagnetic interference generated during operation of the transformer is conducted away to the ground terminals of the system circuit board. Under this circumstance, no copper foil is required to shield the outer periphery of the transformer such that the fabricating cost is reduced and the throughput is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a bobbin comprising a winding member, a first channel, and multiple ground pins, wherein said first channel runs through said winding member, and said ground pins are penetrated through said bobbin and have first terminal parts protruded from a surface of said bobbin;

a primary winding coil and a secondary winding coil wound around said winding member;

a case comprising a receiving portion for partially accommodating said winding member therein, a second channel communicated with said receiving portion, and multiple perforations corresponding to said ground pins, wherein said first terminal parts of said ground pins are penetrated through said perforations and protruded from a surface of said case when said winding member is accommodated in said receiving portion; and a magnetic core assembly partially embedded into said first channel of said bobbin and said second channel of said case, so that said magnetic core assembly is contacted with said first terminal parts of said ground pins, wherein said case further comprises at least one raised block, which is arranged on a base plate of said case and sustained against said magnetic core assembly so as to facilitate fixing said magnetic core assembly on said case.

2. The transformer according to claim 1 wherein said magnetic core assembly is an EE-type core assembly.

3. The transformer according to claim 1 wherein said winding member comprises a first winding section and a second winding section, and said primary winding coil and said secondary winding coil are wound around said first winding section and said second winding section, respectively.

4. The transformer according to claim 1 wherein said case further comprises multiple protective slices, which are downwardly extended from bilateral sides of said base plate and corresponding to said secondary winding coil for partially shielding said secondary winding coil.

5. The transformer according to claim 3 wherein said receiving portion further comprises a ventilation hole corresponding to said first winding section of said winding member for dissipating heat generated by said primary winding coil and said secondary winding coil.

6. The transformer according to claim 1 wherein said bobbin further comprises multiple first pin seats, which are disposed on bilateral sides of said winding member.

7. The transformer according to claim 6 wherein each of said ground pins is arranged on a corresponding first pin seat and comprises said first terminal part and a second terminal part, wherein said first terminal part and said second terminal part are integrally formed, said second terminal part is penetrated through said first pin seat and protruded downwardly from a lower surface of said first pin seat, and said first terminal part is slantwise protruded from an upper surface of said first pin seat to be contacted with said magnetic core assembly.

8. The transformer according to claim 7 wherein said bobbin further comprises multiple second pin seats, which are disposed between said first pin seats.

9. The transformer according to claim 8 wherein said bobbin further comprises multiple conductive pins, which are penetrated through said first pin seats or said second pin seats and have respective terminal parts protruded downwardly from the lower surfaces of said first pin seats or said second pin seats.

10. The transformer according to claim 1 wherein said case further comprises a fixing member, which are extended from top edges of bilateral sides of said receiving portion and sustained against said magnetic core assembly so as to facilitate close contact between said magnetic core assembly and said first terminal parts of said ground pins.

11. The transformer according to claim 10 wherein said fixing member includes multiple sustaining blocks, which are substantially disposed on four corners of said receiving portion.

12. The transformer according to claim 10 wherein said fixing member includes multiple sustaining protrusion plates, which are disposed on bilateral side of said receiving portion, and each sustaining protrusion plate has a length equal to said receiving portion.

* * * * *